US006997999B2

(12) United States Patent
Houston et al.

(10) Patent No.: US 6,997,999 B2
(45) Date of Patent: Feb. 14, 2006

(54) METHOD OF MAKING CORROSION-PROTECTED COAXIAL CABLE

(75) Inventors: Eddy Houston, Newton, NC (US); Benedict Maresca, Belmont, NC (US)

(73) Assignee: CommScope Properties LLC, Sparks, NV (US)

( * ) Notice: Subject to any disclaimer, the term of this patent is extended or adjusted under 35 U.S.C. 154(b) by 245 days.

(21) Appl. No.: 10/616,024

(22) Filed: Jul. 9, 2003

(65) Prior Publication Data

US 2004/0007308 A1 Jan. 15, 2004

Related U.S. Application Data

(62) Division of application No. 09/552,903, filed on Apr. 20, 2000, now Pat. No. 6,596,393.

(51) Int. Cl.
*H01B 13/00* (2006.01)

(52) U.S. Cl. ..... 156/51; 427/372.2; 427/430.1

(58) Field of Classification Search ..... 156/47, 156/51, 53, 54, 52; 428/389; 174/23 C, 174/23 R, 28; 427/372.2, 430.1
See application file for complete search history.

(56) References Cited

U.S. PATENT DOCUMENTS 3,147,223 A 9/1964 Boies et al.
3,413,227 A 11/1968 Kearey et al.
3,625,894 A 12/1971 Koenig et al.
4,343,660 A 8/1982 Martin
4,515,992 A 5/1985 Gupta
4,675,215 A * 6/1987 Ciuba et al. ..... 427/372.2
5,153,032 A 10/1992 Landers et al.
5,254,188 A 10/1993 Blew
5,338,346 A 8/1994 Luttinger et al.
5,521,331 A * 5/1996 Hillburn ..... 174/36
5,560,536 A 10/1996 Moe
5,681,378 A 10/1997 Kerherve
5,719,353 A 2/1998 Carlson et al.
5,777,535 A 7/1998 Farfoud et al.
5,900,048 A 5/1999 Olson et al.
5,959,245 A 9/1999 Moe et al.
6,137,058 A 10/2000 Moe et al.
6,201,189 B1 3/2001 Carlson et al.
6,265,667 B1 7/2001 Stipes et al.

* cited by examiner

*Primary Examiner*—John T. Haran
(74) *Attorney, Agent, or Firm*—Alston & Bird LLP

(57) ABSTRACT

The present invention is a corrosion-protected cable, a method of making a corrosion-inhibiting cable, and a corrosion-inhibiting composition. The corrosion-inhibiting composition includes a water-insoluble corrosion-inhibiting compound dispersed in an oil, and a stabilizer selected from the group consisting of propylene based glycol ethers, propylene based glycol ether acetates, ethylene based glycol ethers and ethylene based glycol ether acetates. The corrosion-inhibiting composition is preferably applied to the outer conductor of the coaxial cable, e.g., by wiping or by immersion, and heated to provide a corrosion-inhibiting coating that is not tacky or greasy.

34 Claims, 4 Drawing Sheets

METHOD OF MAKING CORROSION-PROTECTED COAXIAL CABLE

CROSS-REFERENCE TO RELATED APPLICATIONS

This application is a divisional of U.S. application Ser. No. 09/552,903, filed Apr. 20, 2000, now U.S. Pat. No. 6,596,393, which is hereby incorporated herein in its entirety by reference.

FIELD OF THE INVENTION

The invention relates to a coaxial cable and more particularly, to corrosion-protected trunk and distribution cable and drop cable for the transmission of RF signals.

BACKGROUND OF THE INVENTION

RF signals such as cable television signals, cellular telephone signals, and even internet and other data signals, are often transmitted through coaxial cable to a subscriber. In particular, the RF signals are typically transmitted over long distances using trunk and distribution cable and drop cables are used as the final link in bringing the signals from the trunk and distribution cable to the subscriber. Trunk and distribution cable and drop cable both generally include a center conductor, a dielectric layer, an outer conductor and often a protective jacket to prevent moisture from entering the cable.

One problem associated with these coaxial cables is that moisture present in the cable can corrode the conductors thus negatively affecting the electrical and mechanical properties of the cable. In particular, during installation of the cable, moisture can enter the cable at the connectors. This moisture can also travel within the cable through the dielectric layer or along interfaces in the cable, e.g., between the dielectric layer and the outer conductor.

Several methods have been proposed to prevent moisture from entering the cable and being transported through the cable. For example, hydrophobic, adhesive compositions have been applied at interfaces in the cable to prevent moisture from moving along these interfaces. Flooding or water-blocking compositions have also been used at other locations in the cable to limit water transport in the cable. In addition, hydrophilic, moisture-absorbent materials have been used in cables to act as water-blocking materials. These hydrophilic materials not only water-block the cable but also remove moisture that is present in the cable.

Although these materials can provide adequate protection from moisture and can limit corrosion of the conductors in the cable, these materials have a tacky or greasy feel and thus are undesirable during the installation and connectorization of the cable, particularly when located on the outer conductor of the cable. As a result, these materials generally must be removed or otherwise addressed during installation and connectorization of the cable. Therefore, there is a need to provide a corrosion-inhibiting coating for cable that does not possess a tacky or greasy feel and thus that does not interfere with installation and connectorization of the cable.

SUMMARY OF THE INVENTION

The present invention provides a corrosion-protected cable that includes a corrosion-inhibiting coating that limits and even prevents the corrosion of the conductors, and particularly the outer conductor, of the cable. In addition, the present invention includes a corrosion-inhibiting composition and a method of applying the corrosion-inhibiting composition to the outer conductor of a cable. The corrosion-inhibiting composition when heated forms a corrosion-inhibiting coating on the surface of the outer conductor that is not tacky or greasy and thus is desirable in the art.

According to one embodiment of the invention, the present invention includes a coaxial cable, comprising an elongate center conductor, a dielectric layer surrounding the center conductor, an outer conductor surrounding the dielectric layer, a corrosion-inhibiting coating on at least an outer portion of the outer conductor, and preferably a polymer jacket around the outer conductor. The center conductor is preferably formed of a material selected from the group consisting of copper, a copper alloy, a copper-clad metal, and a copper alloy-clad metal. The dielectric layer preferably comprises a foamed polymeric material. The cable can further include a corrosion-inhibiting layer between the center conductor and the dielectric layer comprising a benzotriazole compound (e.g. BTA) and a polymeric compound (e.g. a foamed, low-density polyethylene). The outer conductor is preferably formed of aluminum or an aluminum alloy but can be copper or another conductive material. For example, the outer conductor can include a bonded aluminum-polymer-aluminum laminate tape extending longitudinally of the cable preferably having overlapping longitudinal edges and the corrosion-inhibiting composition can be applied to an outer surface of said laminate tape. The outer conductor can further include a plurality of braided or helically arranged wires coated with the corrosion-inhibiting composition. Alternatively, the outer conductor can include a longitudinally-welded sheath and the corrosion-inhibiting composition can be applied to an outer surface of the sheath. The corrosion-inhibiting coating comprises a corrosion-inhibiting compound selected from the group consisting of petroleum sulfonates, benzotriazoles, alkylbenzotriazoles, benzimidazoles, guanadino benzimidazoles, phenyl benzimidazoles, tolyltriazoles, metcaptotriazoles, mercaptobenzotriazoles, and salts thereof. In addition, the corrosion-inhibiting coating can include a residual amount of an oil dispersant and/or a residual amount of a stabilizer.

In accordance with the invention, the corrosion-inhibiting composition includes a water-insoluble corrosion-inhibiting compound dispersed in an oil, and a stabilizer selected from the group consisting of propylene based glycol ethers, propylene based glycol ether acetates, ethylene based glycol ethers and ethylene based glycol ether acetates. The stabilizer is preferably selected from the group consisting of dipropylene glycol methyl ether acetate, propylene glycol methyl ether, dipropylene glycol methyl ether, tripropylene glycol methyl ether, propylene glycol t-butyl ether, propylene glycol methyl ether acetate, ethylene glycol methyl ether, ethylene glycol ethyl ether, ethylene glycol butyl ether, diethylene glycol methyl ether, diethylene glycol ethyl ether, diethylene glycol butyl ether, ethylene glycol ethyl ether acetate, ethylene glycol butyl ether acetate, diethylene glycol ethyl ether acetate, diethylene glycol butyl ether acetate, and mixtures thereof, and is more preferably a dipropylene glycol ether acetate (e.g. dipropylene glycol methyl ether acetate). The corrosion-inhibiting compound is selected from the group consisting of petroleum sulfonates, benzotriazoles, alkylbenzotriazoles, benzimidazoles, guanadino benzimidazoles, phenyl benzimidazoles, tolyltriazoles, metcaptotriazoles, mercaptobenzotriazoles, and salts thereof, and is preferably a petroleum sulfonate salt. The petroleum sulfonate salt is selected from the group consisting of calcium, barium, magnesium, sodium, potassium and ammonium salts, and mixtures thereof, and is preferably a calcium salt having an activity of greater than 0 to about 25% based on the calcium salt. The calcium salt optionally further includes a salt selected from the group consisting of barium and sodium salts. The oil is preferably a paraffinic oil such as a mineral oil that preferably has a molecular weight of less than about 600. The corrosion-inhibiting composition preferably includes the corrosion-inhibiting compound in an amount of from about 5 to about 40% by weight, the oil in an amount of from about 50 to about 90% by weight, and the stabilizer in an amount of from about 1 to about 10% by weight. More preferably, the corrosion-inhibiting composition includes the corrosion-inhibiting compound in an amount of from about 15 to about 30% by weight, the oil in an amount of from about 60 to about 80% by weight, and the stabilizer in an amount of from about 3 to about 8% by weight. The corrosion-inhibiting composition preferably also has a viscosity of from about 50 to about 450 SSU at 100° F. The corrosion-inhibiting composition can be heated to form the corrosion-inhibiting coating of the invention that is present on at least a portion of the outer surface of the outer conductor.

The present invention further includes a method of making a coaxial cable, comprising the steps of advancing a center conductor along a predetermined path of travel, applying a dielectric layer around the center conductor, applying an outer conductor around the dielectric layer, and applying the corrosion-inhibiting composition to the outer conductor. The cable can then be heated to produce the corrosion-inhibiting coating, e.g., by applying a polymer melt around the outer conductor to form a protective jacket. The outer conductor can be formed by directing an aluminum-polymer-aluminum laminate tape around the dielectric layer and overlapping longitudinal edges of the laminate tape to form the outer conductor. The outer conductor can also include a plurality of wires formed into a braid or helically arranged around the laminate tape and the corrosion-inhibiting composition applied to the wires by wiping the wires with the corrosion-inhibiting composition. The corrosion-inhibiting composition can also be applied to the outer conductor by wiping the outer surface of the laminate tape with the corrosion-inhibiting composition or immersing the cable in the corrosion-inhibiting composition prior to forming the braid or helically arranging the wires. Alternatively, the corrosion-inhibiting composition can be applied to the outer conductor by wiping the outer surface of the outer conductor with the corrosion-inhibiting composition or immersing the cable in the corrosion-inhibiting composition after forming the braid or helically arranging the wires. The outer conductor can also be formed by directing an aluminum strip around the dielectric layer and longitudinally-welding abutting edges of the metal strip, and the corrosion-inhibiting composition applied to the outer conductor by wiping the outer surface of the outer conductor with the corrosion-inhibiting composition or by immersing the cable in the corrosion-inhibiting composition.

These and other features and advantages of the present invention will become more readily apparent to those skilled in the art upon consideration of the following detailed description and accompanying drawings, which describe both the preferred and alternative embodiments of the present invention.

DETAILED DESCRIPTION OF THE PREFERRED EMBODIMENTS

Figure 1:
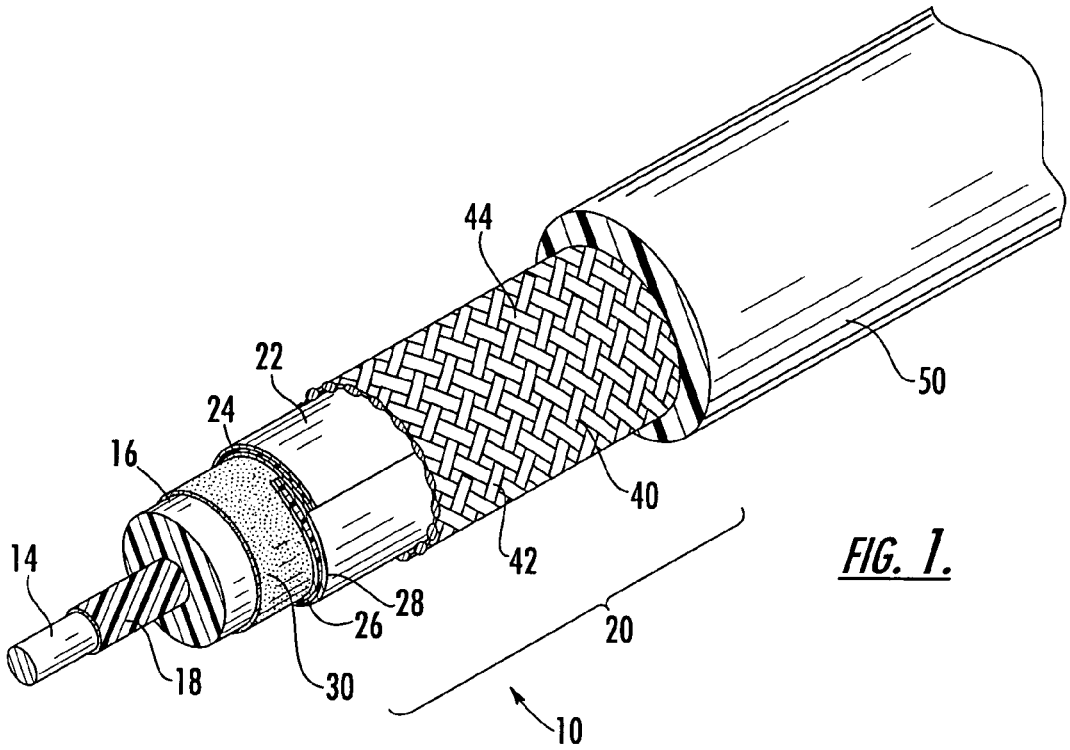
FIG. 1 is a perspective view of a coaxial cable according to one embodiment of the invention that includes a laminate tape and a braid.

In the drawings and the following detailed description, preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications and equivalents as will become apparent from consideration of the following detailed description and accompanying drawings. In the drawings, like numbers refer to like elements throughout. As used herein, the terms "copper" and "aluminum" include not only the pure metals but also alloy compositions that primarily include these metals.

FIG. 1 illustrates a corrosion-protected coaxial cable 10 according to one embodiment of the invention. The cable 10 is of the type typically used as drop cable providing a link for the transmission of RF signals such as cable television signals, cellular telephone signals, internet, data and the like, from a trunk and distribution cable to a subscriber. In particular, the cable 10 is of the type that preferably is used for 50-ohm applications and preferably has a diameter between about 0.24 and 0.41 inches.

As illustrated in FIG. 1, the coaxial cable 10 includes an elongate center conductor 14 of a suitable electrically conductive material and a surrounding dielectric layer 16. As mentioned above, the center conductor 14 of the cable 10 of the invention is generally used in the transmission of RF signals. Preferably, the center conductor 14 is formed of copper, copper-clad steel wire, or copper-clad aluminum wire but other conductive wires can also be used. The center conductor is also preferably 20 AWG wire having a nominal diameter of about 0.032 inches (0.81 mm).

The dielectric layer 16 can be formed of either a foamed or a solid dielectric material. Preferably, the dielectric layer 16 is a low loss dielectric formed of a polymeric material that is suitable for reducing attenuation and maximizing signal propagation such as polyethylene, polypropylene or polystyrene. Preferably, the dielectric layer is an expanded cellular foam composition such as a foamed polyethylene, e.g., a foamed high-density polyethylene. A solid (unfoamed) polyethylene layer can also be used in place of the foamed polyethylene or can be applied around the foamed polyethylene. The dielectric layer 16 is preferably continuous from the center conductor 14 to the adjacent overlying layer.

In addition to the dielectric layer 16, the cable 10 can include a thin polymeric layer 18. Preferably, the thin polymeric layer 18 is a corrosion-inhibiting layer comprising a polymeric material and a corrosion-inhibiting compound. In the preferred embodiment of the invention wherein the center conductor 14 is copper wire or a copper-clad wire, the polymeric layer 18 is preferably low density polyethylene in combination with a small amount of a benzotriazole compound such as benzotriazole (BTA), benzotriazole salts (e.g. ammonium benzotriazole), mercaptobenzotriazoles, alkylbenzotriazoles, and the like. Preferably, the polymeric layer includes from about 0.1 to about 1.0% by weight of BTA. BTA can be purchased, for example, from PMC Specialties under the name COBRATEC® 99. Alternatively, the polymeric layer 18 can be an adhesive composition such as an ethylene-acrylic acid (EAA), ethylene-vinyl acetate (EVA), or ethylene methylacrylate (EMA) copolymer, or another suitable adhesive.

As shown in FIG. 1, an outer conductor 20 closely surrounds the dielectric layer 16. The outer conductor 20 advantageously prevents leakage of the signals being transmitted by the center conductor 14 and interference from outside signals. The outer conductor 20 preferably includes a laminated shielding tape 22 that extends longitudinally along the cable 10. Preferably, the shielding tape 22 is longitudinally applied such that the edges of the shielding tape are either in abutting relationship or are overlapping to provide 100% shielding coverage. More preferably, the longitudinal edges of the shielding tape 22 are overlapped. The shielding tape 22 includes at least one conductive layer such as a thin metallic foil layer. Preferably, the shielding tape is a bonded laminate tape including a polymer layer 24 with metal layers 26 and 28 bonded to opposite sides of the polymer layer. The polymer layer 24 is preferably a polyolefin (e.g. polypropylene) or a polyester film. The metal layers 26 and 28 are preferably thin aluminum foil layers. To prevent cracking of the aluminum in bending, the aluminum foil layers 26 and 28 can be formed of an aluminum alloy having generally the same tensile and elongation properties as the polymer layer 24.

The shielding tape 22 is preferably bonded to the dielectric layer 16 by a thin adhesive layer 30 (e.g., having a thickness of less than 1 mil). More preferably, the shielding tape 22 includes an adhesive on one surface thereof such as an ethylene-acrylic acid (EAA), ethylene-vinyl acetate (EVA), or ethylene methylacrylate (EMA) copolymer to provide the adhesive layer 30 between the dielectric layer 16 and the shielding tape. Alternatively, however, the adhesive layer 30 can be provided by other suitable means to the outer surface of the dielectric layer 16. Preferably, the shielding tape 22 is a bonded aluminum-polypropylene-aluminum laminate tape with an EAA copolymer adhesive backing.

As shown in FIG. 1, the outer conductor 20 preferably further includes a braid 40 that surrounds the shielding tape 22 and is formed by interlacing a first plurality of elongate aluminum wires 42 and a second plurality of elongate aluminum wires 44. Preferably, the braid 40 uses 34 AWG aluminum braid wires. The braid 40 preferably covers a substantial portion of the shielding tape 22, e.g., greater than 40% of the shielding tape, and more preferably greater than 65%, to increase the shielding of the outer conductor 20.

Figure 2:
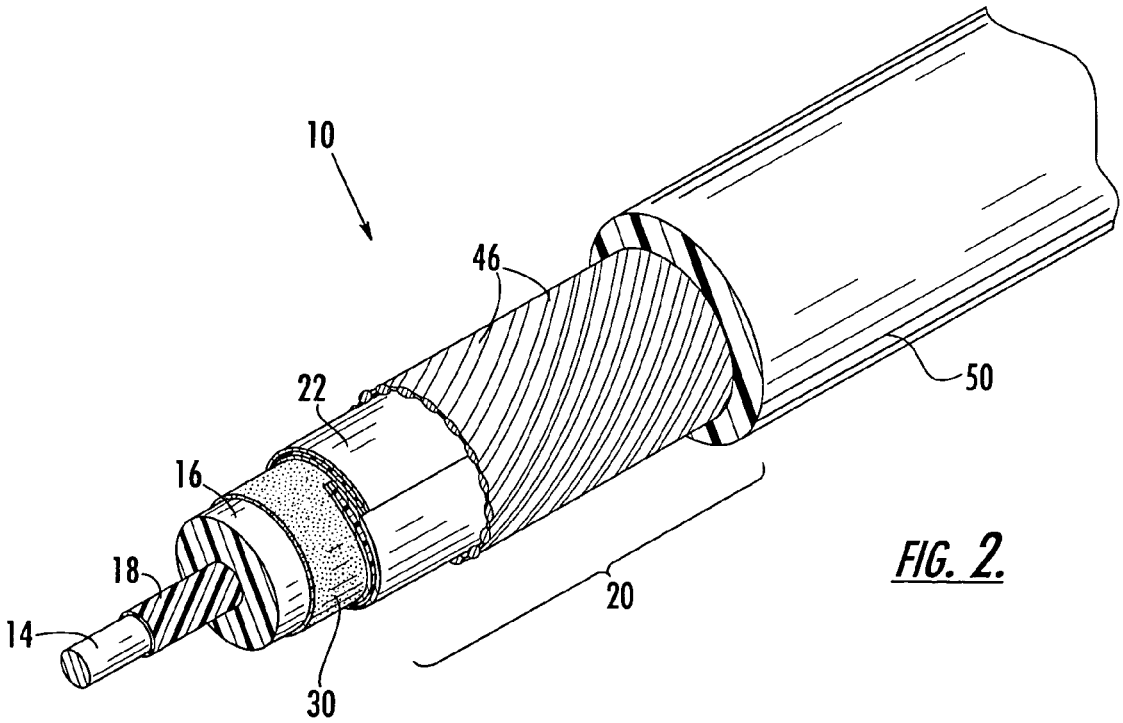
FIG. 2 is a perspective view of a coaxial cable according to yet another embodiment of the invention that includes a laminate tape and helically arranged wires around the laminate tape.

As an alternative to forming a braid 40, a plurality of elongate aluminum wires 46 can be helically arranged around the underlying laminate tape 22 as shown in FIG. 2. A second plurality of elongate aluminum strands (not shown) can also surround the plurality of elongate wires 46, preferably having an opposite helical orientation than the elongate wires 46, e.g., a counterclockwise orientation as opposed to a clockwise orientation. Like the braid wires 42 and 44, the elongate wires 46 are preferably AWG aluminum braid wire and preferably cover a substantial portion of the shielding tape 22, e.g., greater than 40% of the shielding tape, and more preferably greater than 65%, to increase the shielding of the outer conductor 20.

As shown in FIGS. 1 and 2, a cable jacket 50 can optionally surround the outer conductor 22 to further protect the cable from moisture and other environmental effects. The jacket 50 is preferably formed of a non-conductive, thermoplastic material such as polyethylene, polyvinyl chloride, polyurethane and rubbers. Alternatively, low smoke insulation such as a fluorinated polymer can be used if the cable 10 is to be installed in air plenums requiring compliance with the requirements of UL910.

Figure 3:
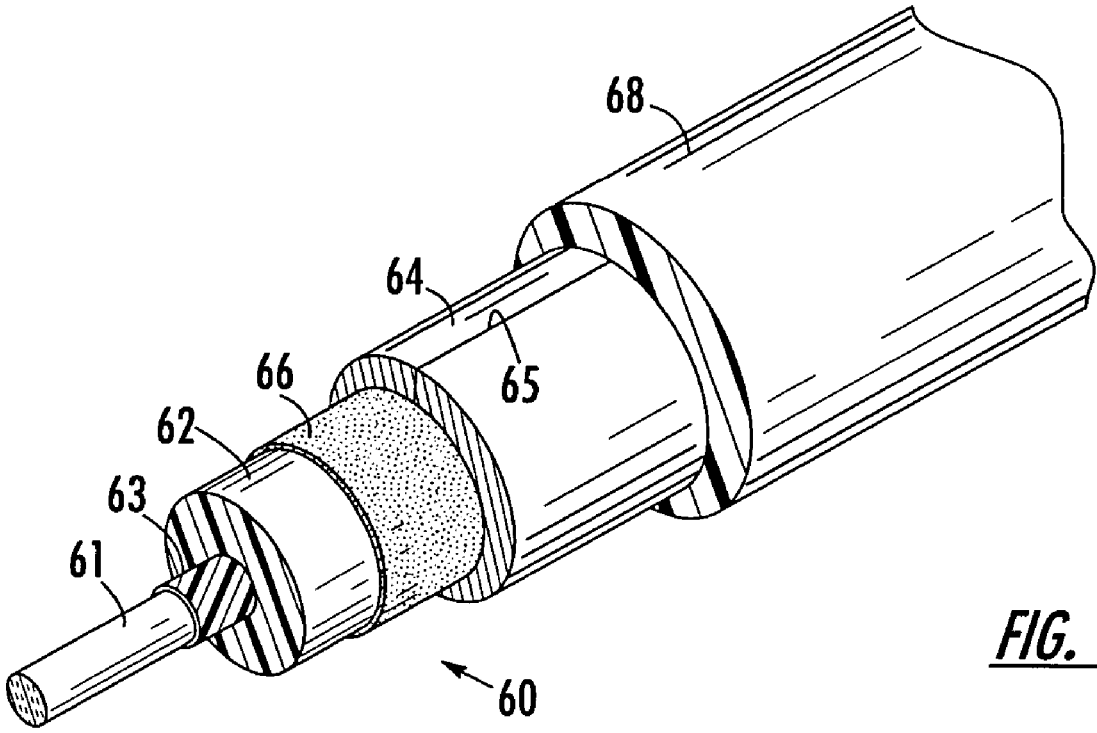
FIG. 3 is a perspective view of a coaxial cable according to another embodiment of the invention that includes a longitudinally-welded outer sheath.

FIG. 3 illustrates a corrosion-protected cable 60 according to another embodiment of the invention. The corrosion-protected cable 60 is of the type typically used for trunk and distribution cable for the long distance transmission of RF signals such as cable television signals, cellular telephone signals, internet, data and the like. The cable 60 illustrated in FIG. 3 typically is of the type typically having a diameter of between about 0.3 and about 1.5 inches.

As illustrated in FIG. 3, the coaxial cable comprises a center conductor 61 of a suitable electrically conductive material and a surrounding dielectric layer 62. The center conductor 61 is preferably formed of copper, copper-clad aluminum, copper-clad steel, or aluminum. In addition, as illustrated in FIG. 3, the center conductor 61 is typically a solid conductor. Nevertheless, the center conductor 61 can also be a hollow tube and can further include a supporting material within the tube as described in coassigned and copending U.S. application Ser. No. 09/485,656, filed Feb. 14, 2000, published as 2002-0053446. In the embodiment illustrated in FIG. 3, only a single center conductor 61 is shown, as this is the most common arrangement for coaxial cables of the type used for transmitting RF signals. However, it would be understood by those skilled in the art that the present invention is also applicable to coaxial cables having more than one conductor in the center of the cable 60.

A dielectric layer 62 surrounds the center conductor 61. The dielectric layer 62 is a low loss dielectric formed of a suitable plastic such as polyethylene, polypropylene or polystyrene. Preferably, to reduce the mass of the dielectric per unit length and thus the dielectric constant, the dielectric material is an expanded cellular foam composition, and in particular, a closed cell foam composition is preferred because of its resistance to moisture transmission. The dielectric layer 62 is preferably a continuous cylindrical wall of expanded foam plastic dielectric material and is more preferably a foamed polyethylene, e.g., high-density polyethylene. As discussed above with respect to FIGS. 1 and 2, in addition to the dielectric layer 62, the cable 60 can include a thin polymeric layer 63. Preferably, the thin polymeric layer 63 is a corrosion-inhibiting layer comprising a polymeric material and a corrosion-inhibiting compound but this layer can alternatively be an adhesive composition.

Although the dielectric layer 62 of the invention generally consists of a foam material having a generally uniform density, the dielectric layer 62 may have a gradient or graduated density such that the density of the dielectric increases radially from the center conductor 61 to the outside surface of the dielectric layer, either in a continuous or a step-wise fashion. For example, a foam-solid laminate dielectric can be used wherein the dielectric 62 comprises a low-density foam dielectric layer surrounded by a solid dielectric layer. These constructions can be used to enhance the compressive strength and bending properties of the cable and permit reduced densities as low as 0.10 g/cc along the center conductor 61. The lower density of the foam dielectric 62 along the center conductor 61 enhances the velocity of RF signal propagation and reduces signal attenuation.

Closely surrounding the dielectric layer 62 is an outer conductor 64. In the embodiment illustrated in FIG. 3, the outer conductor 64 is a tubular metallic sheath. The outer conductor 64 is preferably characterized by being continuous, both mechanically and electrically, to allow the outer conductor 64 to mechanically and electrically seal the cable from outside influences as well as to prevent the leakage of RF radiation. Alternatively, the outer conductor 64 can be perforated to allow controlled leakage of RF energy for certain specialized radiating cable applications. The outer conductor 64 is preferably a thin walled aluminum sheath having a wall thickness selected so as to maintain a T/D ratio (ratio of wall thickness to outer diameter) of less than 2.5 percent and preferably less than 1.6 percent. Although the outer conductor 64 can be corrugated, it is preferably smooth-walled. The smooth-walled construction optimizes the geometry of the cable to reduce contact resistance and variability of the cable when connectorized and to eliminate signal leakage at the connector.

In the embodiment illustrated in FIG. 3, the outer conductor 64 is preferably made from an aluminum strip that is formed into a tubular configuration with the opposing side edges butted together, and with the butted edges continuously joined by a continuous longitudinal weld, indicated at 65. Nevertheless, other materials such as a copper strip can be used in place of the aluminum strip. While production of the outer conductor 64 by longitudinal welding has been illustrated as preferred for this embodiment, persons skilled in the art will recognize that other methods for producing a mechanically and electrically continuous thin walled tubular copper sheath could also be employed such as overlapping the longitudinal edges of the aluminum strip.

The inner surface of the outer conductor 64 is preferably continuously bonded throughout its length and throughout its circumferential extent to the outer surface of the dielectric layer 62 by a thin layer of adhesive 66 (e.g. less than 1 mil) using the adhesive materials discussed above.

As shown in FIG. 3, a protective jacket 68 can optionally be included to surround the outer conductor 64. Suitable compositions for the outer protective jacket 68 include thermoplastic coating materials such as those discussed above. Although the jacket 68 illustrated in FIG. 3 consists of only one layer of material, laminated multiple jacket layers may also be employed to improve toughness, strippability, burn resistance, the reduction of smoke generation, ultraviolet and weatherability resistance, protection against rodent gnaw through, strength resistance, chemical resistance and/or cut-through resistance.

In accordance with the invention, at least an outer portion of the outer conductor 20 (FIGS. 1 and 2) and the outer conductor 64 (FIG. 3) is coated with a corrosion-inhibiting coating. The corrosion-inhibiting coating is coated on the outer conductor in an amount sufficient to protect the outer conductor from moisture and to prevent corrosion of the outer conductor. Preferably, the corrosion-inhibiting coating is coated on at least a significant portion of the outer surface of the outer conductor, e.g., to provide 95% or greater surface coverage of the outer portion of the outer conductor. The corrosion-inhibiting coating comprises a corrosion-inhibiting compound and is formed by heating the corrosion-inhibiting composition discussed below. In addition, the corrosion-inhibiting coating can include a residual amount of an oil dispersant and/or a residual amount of a stabilizer. For example, the corrosion-inhibiting coating preferably includes less than 5% by weight of the oil and less than 5% by weight of the stabilizer, more preferably less than 2% of each of these components.

The corrosion-inhibiting composition of the invention includes a corrosion-inhibiting compound dispersed in an oil, and a stabilizer to maintain the dispersion. The corrosion-inhibiting compound is typically an oil-soluble, water-insoluble compound and can be selected from the group consisting of petroleum sulfonates, benzotriazoles, alkylbenzotriazoles, benzimidazoles, guanadino benzimidazoles, phenyl benzimidazoles, tolyltriazoles, metcaptotriazoles, mercaptobenzotriazoles, and salts thereof. Preferably, the corrosion-inhibiting compound is a petroleum sulfonate salt. The petroleum sulfonate salts of the invention are preferably produced by partially oxidizing an aliphatic petroleum fraction to produce oxygenated hydrocarbons. The oxygenated hydrocarbons are then neutralized with calcium and blended with a minor amount of sodium petroleum sulfonate and a hydrotreated heavy naphthenic petroleum distillate to facilitate handling. Alternatively, the petroleum sulfonate salts can be produced by other known methods such as by reacting sulfuric acid and petroleum distillates to produce olefinic sulfonic acids, neutralizing the olefinic sulfonic acids using an alkali metal hydroxide, alkaline earth metal hydroxide or ammonium hydroxide, removing the sulfonates from the oil by suitable extraction media, and then further concentrating and purifying the petroleum sulfonate salts. The petroleum sulfonate salts are typically calcium, barium, magnesium, sodium, potassium, or ammonium salts, or mixtures thereof. Preferably, the petroleum sulfonate salts are calcium salts either alone or in combination with barium and/or sodium salts. The petroleum sulfonate salts preferably have a molecular weight of greater than about 400. In the preferred compositions used with the present invention, the petroleum sulfonate salts have an activity of greater than 0 to about 25% based on the calcium salt. Typically, the corrosion-inhibiting composition includes from about 5 to about 40 percent by weight, preferably from about 15 to about 30 percent by weight, of the corrosion-inhibiting compound (e.g. the petroleum sulfonate salt).

The corrosion-inhibiting compound is dispersed in an oil in accordance with the present invention. Preferably, the oil is a paraffinic oil such as a mineral oil. The paraffinic oil includes long chain aliphatic components and preferably has a low molecular weight of less than about 600, more preferably, less than about 500 (e.g. from about 400 to about 500). In addition, the oil can include a small amount of a hydrotreated heavy naphthenic petroleum distillate as these distillates are often used to facilitate handling of the corrosion-inhibiting compound. The oil is present in the corrosion-inhibiting composition in an amount from about 50 to about 90 percent by weight, more preferably from about 60 to about 80 percent by weight.

The corrosion-inhibiting composition further includes a stabilizer to maintain the dispersion between the corrosion-inhibiting compound and the oil. In particular, the stabilizer is selected from the group consisting of propylene based glycol ethers, propylene based glycol ether acetates, ethylene based glycol ethers, and ethylene based glycol ether acetates. For example, dipropylene glycol methyl ether acetate, propylene glycol methyl ether, dipropylene glycol methyl ether, tripropylene glycol methyl ether, propylene glycol t-butyl ether, propylene glycol methyl ether acetate, ethylene glycol methyl ether, ethylene glycol ethyl ether, ethylene glycol butyl ether, diethylene glycol methyl ether, diethylene glycol ethyl ether, diethylene glycol butyl ether, ethylene glycol ethyl ether acetate, ethylene glycol butyl ether acetate, diethylene glycol ethyl ether acetate, diethylene glycol butyl ether acetate, and mixtures thereof, can be used as stabilizers in the present invention. Preferably, the stabilizer for use in the invention is a dipropylene glycol ether acetate and is more preferably dipropylene glycol methyl ether acetate. The corrosion-inhibiting composition preferably includes from about 1% to about 10% by weight of the stabilizer, more preferably from about 3 to about 8 percent by weight of the stabilizer.

The stabilizers mentioned above have been found to be particularly useful in the compositions of the invention in preventing the corrosion-inhibiting compounds, and particularly, the petroleum sulfonate salts, from precipitating out of the oil. Specifically, the stabilizers allow for larger amounts of the corrosion-inhibiting compounds (about 15% by weight or greater) to be used in the corrosion-inhibiting compositions without precipitation of the corrosion-inhibiting compounds.

For use with the cables of the invention, the corrosion-inhibiting composition preferably has a viscosity of from about 50 to about 450 SSU at 100° F. A particularly preferred composition for use with the cables of the invention is a combination of a calcium petroleum sulfonate, mineral oil, and a dipropylene glycol methyl ether acetate stabilizer. This composition is commercially available, e.g., from Arro-Chem Inc. in Mount Holly, N.C. as Anti Corrosion Lube 310, which has a flash point >200° C., a specific gravity of 0.8393, a viscosity of from 290 to 310 SSU at 100° F., and an activity of 10% based on the calcium salt.

Figure 4:
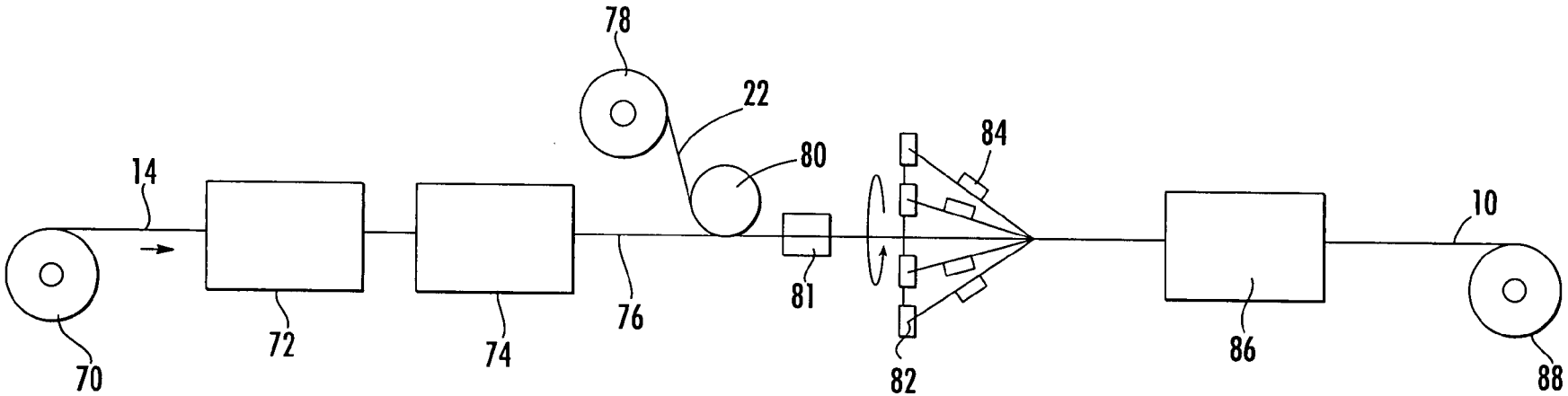
FIG. 4 is a schematic illustration of a method of making a coaxial cable corresponding to the embodiment of the invention illustrated in FIGS. 1 and 2.

FIG. 4 illustrates a preferred method of making the coaxial cable 10 of the invention. As shown in FIG. 4, the center conductor 14 is advanced from a reel 70 along a predetermined path of travel (from left to right in FIG. 4). In order to produce a coaxial cable having a continuous center conductor 14, the terminal edge of the center conductor from one reel is mated with the initial edge of the center conductor from a subsequent reel and welded together. It is important in forming a continuous cable to weld the center conductors from different reels without adversely affecting the surface characteristics and therefore the electrical properties of the center conductor 14.

As the center conductor 14 advances, a suitable apparatus 72 such as an extruder apparatus or a spraying apparatus applies the thin polymeric layer 18. The coated center conductor then further advances to an extruder apparatus 74 that applies a polymer melt composition around the center conductor 14 and polymeric layer 18. As described above, the polymer melt composition is preferably a foamable polyethylene composition. Once the coated center conductor leaves the extruder apparatus 74, the polymer melt composition expands to form the dielectric layer 16. The center conductor 14, polymeric layer 18 and dielectric layer 16 form the cable core 76 of the cable 10. Once the cable core 76 leaves the extruder apparatus 74 and is properly cooled, it can then be continuously advanced through the process shown in FIG. 4 or can be collected on a reel before being further advanced through the process.

As shown in FIG. 4, as the cable core 76 advances, a shielding tape 22 is supplied from a reel 78 and is longitudinally wrapped or "cigarette-wrapped" around the cable core to form an electrically conductive shield. As mentioned above, the shielding tape 22 is preferably a bonded metal-polymer-metal laminate tape having an adhesive on one surface thereof. The shielding tape 22 is applied with the adhesive surface positioned adjacent the underlying cable core 76. If an adhesive layer is not already included on the shielding tape 22, an adhesive layer can be applied by suitable means such as extrusion prior to longitudinally wrapping the shielding tape around the cable core 76. One or more guiding rolls 80 direct the shielding tape 22 around the cable core 76 with longitudinal edges of the shielding tape preferably overlapping to provide a conductive shield having 100% shielding coverage of the cable core.

Once the shielding tape 22 is applied around the cable core 76, the corrosion-inhibiting composition of the invention can optionally be applied to the outer surface of the shielding tape by suitable means such as by using felt 81 to wipe the composition onto the outer surface. Alternatively, other means such as extruding or spraying the corrosion-inhibiting composition onto the outer surface of the shielding tape, or immersing the cable in the composition, can be used. As described below for the cable 10, the corrosion-inhibiting composition of the invention is preferably applied to the surrounding braided or helically served wires, and the shielding tape 22 precoated with a corrosion-inhibiting composition. Shielding tapes precoated with corrosion-inhibiting compositions and suitable for use in the invention are available, e.g., from Facile Holdings, Inc. in Paterson, N.J.

As mentioned above, in the preferred embodiment of the invention illustrated in FIG. 1, a braid 40 is formed around the shielding tape 22 and combined with the shielding tape forms the outer conductor 20 of the cable 10. As shown schematically in FIG. 4, the braid 40 is formed by feeding a first plurality of aluminum wires 42 and a second plurality of aluminum wires 44 from a plurality of bobbins 82 and interlacing the wires to form the braid. Preferably, the braid wires 42 and 44 are coated with the corrosion-inhibiting composition of the invention prior to braiding. Advantageously, the corrosion-inhibiting compound also acts as a lubricant and thus aids in the braiding of the wires. The corrosion-inhibiting composition of the invention can be applied to the braid wires 42 and 44 either at wire drawing, spooling or braiding such as by wiping the composition onto the surface of the braid wires. For example, felts 84 can be used to wipe the corrosion-inhibiting composition onto the outer surface of the braid wires 42 and 44. Alternatively, the corrosion-inhibiting composition can be applied by spraying the braid wires 42 and 44 or immersing the braid wires in the composition prior to braiding, by wiping or spraying the braid with the composition after it is formed, or by immersing the braided cable in the composition after the braid is formed.

As an alternative to the embodiment of FIG. 1, a plurality of elongate aluminum wires 46 can be helically arranged or "served" around the shielding tape 22 instead of forming a braid as shown in FIG. 2. In this embodiment, the elongate wires 46 drawn from the bobbins 82 are not interlaced to form a braid but are instead helically wound around the shielding tape 22. The elongate wires 46 are preferably coated with the corrosion-inhibiting composition in the same manner as the braid wires 42 and 44 described above by wiping the composition onto the wires using, for example, the felts 81, or can be applied by the other means described above. Although not illustrated in FIG. 4, an additional plurality of bobbins can be used to apply a second plurality of elongate wires around the first plurality of elongate strands 46, preferably having a helical orientation opposite that of the first plurality of elongate strands and coated with the corrosion-inhibiting composition.

Once either the braid 40 has been formed around the shielding tape 22 or the elongate wires 46 helically wound around the shielding tape 22 to form the outer conductor 20, the cable can be advanced to an extruder apparatus 86 and a polymer melt extruded at an elevated temperature (e.g. greater than about 250° F.) around the elongate strands to form the cable jacket 50. The heat of the polymer melt activates the adhesive between the laminate tape 30 to form a bond between the laminate tape and the underlying dielectric 16. In addition, the heat of the polymer melt causes the oil and the dispersant in the corrosion-inhibiting composition to evaporate leaving the corrosion-inhibiting compound behind on the surface of the outer conductor 20. The cable jacket 50 can then be allowed to cool and the completed cable 10 taken up on a reel 88 for storage and shipment.

Although a jacket is preferably applied as discussed above, the cable can be heated to evaporate the oil and dispersant in the corrosion-inhibiting composition without applying a jacket to the cable. Moreover, although less preferred, the corrosion-inhibiting composition can be left on the cable without heating the cable.

Figure 5A:
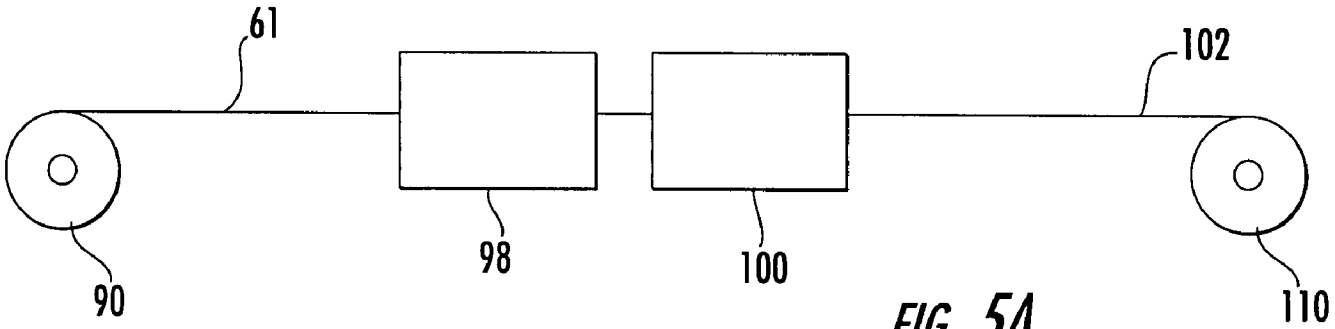
FIGS. 5A and 5B schematically illustrate a method of making a coaxial cable corresponding to the embodiment of the invention illustrated in FIG. 3.
Figure 5B:
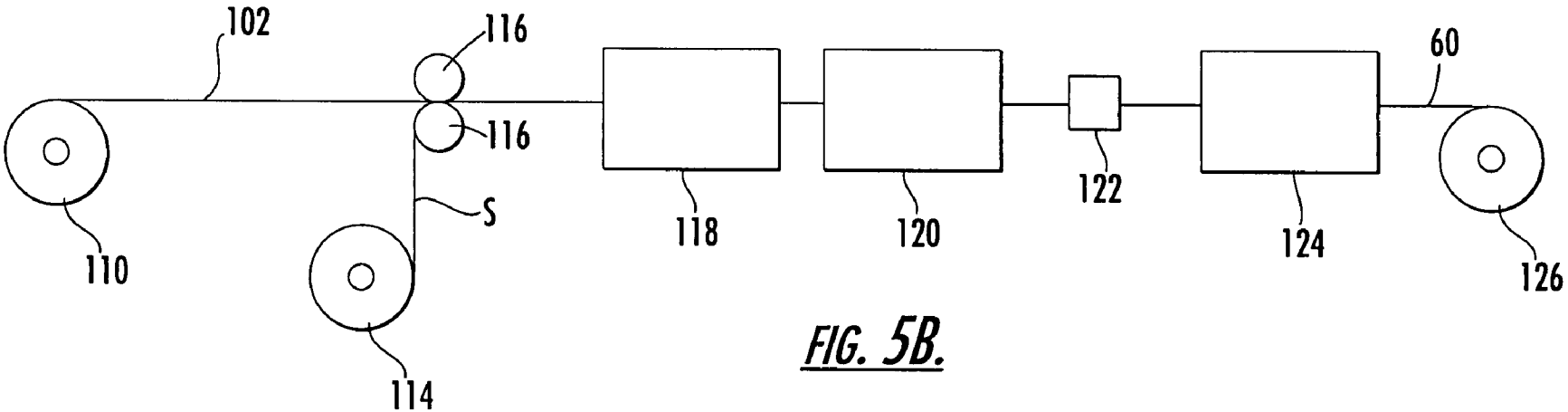

FIGS. 5A and 5B illustrate another method embodiment of the invention corresponding to cables such as the cable 60 illustrated in FIG. 3. As illustrated in FIG. 5A, the center conductor 61 is directed from a suitable supply source, such as a reel 90. As mentioned above, to provide a coaxial cable having a continuous center conductor 14, the terminal edge of the center conductor from one reel is mated with the initial edge of the center conductor from a subsequent reel and welded together, preferably without adversely affecting the surface characteristics and therefore the electrical properties of the center conductor.

The center conductor 61 is then preferably advanced to an extruder apparatus 98 or other suitable apparatus wherein it is coated with a polymeric material to form the thin polymeric layer 63. The coated center conductor 61 is then advanced to an extruder apparatus 100 that continuously applies a foamable polymer composition concentrically around the coated center conductor. Preferably, high-density polyethylene and low-density polyethylene are combined with nucleating agents in the extruder apparatus 100 to form the polymer melt. Upon leaving the extruder 100, the foamable polymer composition foams and expands to form a dielectric layer 62 around the center conductor 61.

In addition to the foamable polymer composition, an ethylene acrylic acid (EAA) adhesive composition or other suitable composition is preferably coextruded with the foamable polymer composition around the center conductor to form adhesive layer 66. Extruder apparatus 100 continuously extrudes the adhesive composition concentrically around the polymer melt to form an adhesive coated core 102. Although coextrusion of the adhesive composition with the foamable polymer composition is preferred, other suitable methods such as spraying, immersion, or extrusion in a separate apparatus can also be used to apply the adhesive layer 66 to the dielectric layer 62 to form the adhesive coated core 102.

In order to produce low foam dielectric densities along the center conductor 61 of the cable 60, the method described above can be altered to provide a gradient or graduated density dielectric. For example, for a multilayer dielectric having a low density inner foam layer and a high density foam or solid outer layer, the polymer compositions forming the layers of the dielectric can be coextruded together and can further be coextruded with the adhesive composition forming adhesive layer 66. Alternatively, the dielectric layers can be extruded separately using successive extruder apparatus. Other suitable methods can also be used. For example, the temperature of the inner conductor 61 may be elevated to increase the size and therefore reduce the density of the cells along the inner conductor to form a dielectric having a radially increasing density.

After leaving the extruder apparatus 100, the adhesive coated core 102 is preferably cooled and then collected on a suitable container, such as reel 110, prior to being advanced to the manufacturing process illustrated in FIG. 5B. Alternatively, the adhesive coated core 102 can be continuously advanced to the manufacturing process of FIG. 5B without being collected on a reel 110.

As illustrated in FIG. 5B, the adhesive coated core 102 can be drawn from reel 110 and further processed to form the coaxial cable 60. A narrow elongate strip S, preferably formed of aluminum, from a suitable supply source such as reel 114 is directed around the advancing core 102 and bent into a generally cylindrical form by guide rolls 116 so as to loosely encircle the core to form a tubular sheath 64. Opposing longitudinal edges of the strip S can then be moved into abutting relation and the strip advanced through a welding apparatus 118 that forms a longitudinal weld 65 by joining the abutting edges of the strip S to form an electrically and mechanically continuous sheath 64 loosely surrounding the core 102. Alternatively, the strip S can be arranged such that the opposing longitudinal edges of the strip S overlap to form the electrically and mechanically continuous sheath 64.

Once the sheath 64 is longitudinally welded, the sheath 64 can be formed into an oval configuration and weld flash scarfed from the sheath as set forth in U.S. Pat. No. 5,959,245, especially if thin walled sheaths are being formed. Alternatively, or after the scarfing process, the core 102 and surrounding sheath 64 can advance directly through at least one sinking die 120 that sinks the sheath onto the core 102, thereby causing compression of the dielectric 16. A lubricant is preferably applied to the surface of the sheath 64 as it advances through the sinking die 120. The cable then advances from the sinking die 120 to a suitable apparatus for applying the corrosion-inhibiting composition of the invention to the outer surface of the sheath 64. Preferably, the corrosion-inhibiting composition is applied to the sheath 64 by wiping the composition onto the sheath, e.g., by using felt 122 as illustrated in FIG. 5B. Alternatively, other means such as extruding or spraying the corrosion-inhibiting composition onto the outer surface of the sheath 64, or immersing the thus-formed cable 60 in the composition can be used.

Once the corrosion-inhibiting composition has been applied to the sheath 64, the cable can optionally be advanced to an extruder apparatus 124 and a polymer melt extruded concentrically around the sheath to produce a protective polymeric jacket 68. If multiple polymer layers are used to form the jacket 68, the polymer compositions forming the multiple layers may be coextruded together in surrounding relation to form the protective jacket. Additionally, a longitudinal tracer stripe of a polymer composition contrasting in color to the protective jacket 68 can be coextruded with the polymer composition forming the jacket for labeling purposes.

The heat of the polymer melt that produces the jacket 68 activates the adhesive layer 66 between the sheath 64 and the dielectric layer 62 to form a bond between the sheath and dielectric layer. In addition, the heat of the polymer composition causes the oil and dispersant in the corrosion-inhibiting composition to evaporate leaving the corrosion-inhibiting compound behind on the surface of the outer conductor 20. Once the protective jacket 68 has been applied, the coaxial cable is subsequently cooled to harden the jacket. However, as discussed above, the cable can be heated without applying a jacket or, less preferably, can proceed without heating. The thus produced cable can then be collected on a suitable container, such as a reel 126 for storage and shipment.

Unlike the flooding compounds and water-blocking compounds of the prior art, the corrosion-inhibiting coating of the invention do not have a greasy or sticky feel or texture in the finished cable. In particular, the oil and the stabilizer in the corrosion-inhibiting composition generally evaporate after the cable has been heated (e.g. by the application of the cable jacket) in much the same way that the lubricating oil used in braiding evaporates when heated such that the outer conductor includes only a residual amount of the oil and/or the stabilizer, if any. As a result, the outer conductor of the finished cable generally does not include the oily feel that the corrosion-inhibiting composition has at the time of application. Thus, unlike prior art corrosion-inhibiting coatings, the corrosion-inhibiting coating of the invention does not interfere with installation or connectorization of the cable. As would be understood by those skilled in the art, this is an important feature of the present invention and provides a real advantage over prior art corrosion-inhibiting compounds. As would be understood by those skilled in the art, in constructions that do not use cable jackets, the cable can be heated in a separate process step to evaporate the oil and provide the corrosion-protected cables of the invention.

The corrosion-inhibiting compositions of the invention have been found to be particularly useful with outer conductors formed of aluminum. Specifically, with respect to aluminum outer conductors, it has been found that the corrosion-inhibiting compound produces a bond with the aluminum such that it is well maintained on the surface of the outer conductor.

The corrosion-inhibiting compositions of the invention provide excellent protection to the outer conductor of the cable, and the cable as a whole. Although the present invention has been described for use with drop cable and trunk and distribution cable above, the present invention is not limited to these embodiments. In particular, the corrosion-inhibiting composition can be used with any type of cable wherein limiting the corrosion at conductors in the cable is important. In addition, although the corrosion-inhibiting compositions have been described for use with the outer conductor of coaxial cables, it would be understood by those skilled in the art that it could also be applied to the inner conductors, or could be used with metals in other types of applications to provide corrosion protection.

It is understood that upon reading the above description of the present invention and reviewing the accompanying drawings, one skilled in the art could make changes and variations therefrom. These changes and variations are included in the spirit and scope of the following appended claims.

What is claimed is:

1. A method of making a coaxial cable, comprising the steps of:

advancing a center conductor along a predetermined path of travel;

applying a dielectric layer around the center conductor;

applying an outer conductor around the dielectric layer; and applying a corrosion-inhibiting composition to said outer conductor, said corrosion-inhibiting compound comprising a corrosion-inhibiting compound dispersed in a paraffinic oil, and a stabilizer selected from the group consisting of propylene glycol ethers, propylene glycol ether acetates, ethylene glycol ethers and ethylene glycol ether acetates, the corrosion-inhibiting compound being present in the composition in an amount of from about 5 to about 40% by weight, the oil being present in an amount of from about 50 to 90% by weight, and the stabilizer being present in an amount of from about 1 to about 10% by weight.

2. The method according to claim 1, further comprising the step of heating said cable to evaporate the oil and the stabilizer in the corrosion-inhibiting composition.

3. The method according to claim 1, wherein said heating step comprises applying a polymer melt at an elevated temperature around the outer conductor to heat said cable.

4. The method according to claim 1, wherein the stabilizer is selected from the group consisting of dipropylene glycol methyl ether acetate, propylene glycol methyl ether, dipropylene glycol methyl ether, tripropylene glycol methyl ether, propylene glycol t-butyl ether, propylene glycol methyl ether acetate, ethylene glycol methyl ether, ethylene glycol ethyl ether, ethylene glycol butyl ether, diethylene glycol methyl ether, diethylene glycol ethyl ether, diethylene glycol butyl ether, ethylene glycol ethyl ether acetate, ethylene glycol butyl ether acetate, diethylene glycol ethyl ether acetate, diethylene glycol butyl ether acetate, and mixtures thereof.

5. The method according to claim 1, wherein the stabilizer is a dipropylene glycol ether acetate.

6. The method according to claim 1, wherein the stabilizer is dipropylene glycol methyl ether acetate.

7. The method according to claim 1, wherein the corrosion-inhibiting compound is selected from the group consisting of petroleum sulfonates, benzotriazoles, alkylbenzotriazoles, benzimidazoles, guanadino benzimidazoles, phenyl benzimidazoles, tolyltriazoles, metcaptotriazoles, mercaptobenzotriazoles, and salts thereof.

8. The method according to claim 1, wherein the corrosion-inhibiting compound is a petroleum sulfonate salt.

9. The method according to claim 8, wherein the petroleum sulfonate salt is selected from the group consisting of calcium, barium, magnesium, sodium, potassium and ammonium salts, and mixtures thereof.

10. The method according to claim 9, wherein the petroleum sulfonate salt comprises a calcium salt.

11. The method according to claim 10, wherein the petroleum sulfonate salt has an activity of greater than 0 to about 25% based on the calcium salt.

12. The method according to claim 10, wherein the petroleum sulfonate salt further comprises a salt selected from the group consisting of barium and sodium salts.

13. The method according to claim 1, wherein the paraffinic oil has a molecular weight of less than about 600.

14. The method according to claim 1, wherein the paraffinic oil is a mineral oil.

15. The method according to claim 1, wherein the corrosion-inhibiting compound is present in an amount of from about 15 to about 30% by weight, the oil is present in an amount of from about 60 to about 80% by weight, and the stabilizer is present in an amount of from about 3 to about 8% by weight.

16. The method according to claim 1, wherein the corrosion-inhibiting composition has a viscosity of from about 50 to about 450 SSU at 100° F.

17. The method according to claim 1, wherein said step of applying a corrosion-inhibiting composition to the outer conductor comprises wiping the outer surface of the outer conductor with the corrosion-inhibiting composition.

18. The method according to claim 1, wherein said step of applying a corrosion-inhibiting composition to the outer conductor comprises immersing the cable in the corrosion-inhibiting composition.

19. The method according to claim 1, wherein said step of applying an outer conductor comprises applying an outer conductor formed of aluminum or an aluminum alloy.

20. The method according to claim 1, wherein said step of applying an outer conductor includes the step of directing an aluminum-polymer-aluminum laminate tape around the dielectric layer and overlapping longitudinal edges of the laminate tape to form the outer conductor.

21. The method according to claim 20, wherein said step of applying an outer conductor further includes the step of forming wires into a braid around the laminate tape after said directing step.

22. The method according to claim 21, wherein said step of applying a corrosion-inhibiting composition to the outer conductor includes the step of applying the corrosion-inhibiting composition to the wires prior to said forming step.

23. The method according to claim 22, wherein said step of applying the corrosion-inhibiting composition to the wires comprises wiping the wires with the corrosion-inhibiting composition.

24. The method according to claim 22, wherein said step of applying a corrosion-inhibiting composition to the outer conductor further comprises wiping the outer surface of the laminate tape with the corrosion-inhibiting composition prior to said forming step.

25. The method according to claim 22, wherein said step of applying a corrosion-inhibiting composition to the outer conductor comprises wiping the cable with the corrosion-inhibiting composition after said forming step.

26. The method according to claim 21, wherein said step of applying a corrosion-inhibiting composition to the outer conductor comprises immersing the cable in the corrosion-inhibiting composition after said forming step.

27. The method according to claim 20, wherein said step of applying an outer conductor further includes the step of arranging a plurality of wires helically around the laminate tape after said directing step.

28. The method according to claim 27, wherein said step of applying a corrosion-inhibiting composition to the outer conductor includes the step of applying the corrosion-inhibiting composition to the wires prior to said arranging step.

29. The method according to claim 28, wherein said step of applying the corrosion-inhibiting composition to the wires comprises wiping the wires with the corrosion-inhibiting composition.

30. The method according to claim 28, wherein said step of applying a corrosion-inhibiting composition to the outer conductor further comprises wiping the outer surface of the laminate tape with the corrosion-inhibiting composition prior to said arranging step.

31. The method according to claim 27, wherein said step of applying a corrosion-inhibiting composition to the outer conductor comprises wiping the cable with the corrosion-inhibiting composition after said arranging step.

32. The method according to claim 27, wherein said step of applying a corrosion-inhibiting composition to the outer conductor comprises immersing the cable in the corrosion-inhibiting composition after said arranging step.

33. The method according to claim 1, wherein said step of applying an outer conductor comprises directing an aluminum strip around the dielectric layer and longitudinally-welding abutting edges of the metal strip to form the outer conductor, and said step of applying a corrosion-inhibiting composition to the outer conductor comprises wiping the outer surface of the outer conductor with the corrosion-inhibiting composition.

34. The method according to claim 1, wherein said step of applying an outer conductor comprises directing an aluminum strip around the dielectric layer and longitudinally-welding abutting edges of the metal strip to form the outer conductor, and said step of applying a corrosion-inhibiting composition to the outer conductor comprises immersing the cable in the corrosion-inhibiting composition.

* * * * *